US010344977B2

(12) United States Patent
Mulcaire et al.

(10) Patent No.: US 10,344,977 B2
(45) Date of Patent: Jul. 9, 2019

(54) COMBUSTION CHAMBER HAVING AN ANNULAR OUTER WALL WITH A CONCAVE BEND

(71) Applicant: ROLLS-ROYCE plc, London (GB)

(72) Inventors: Thomas G Mulcaire, Derby (GB); Robert A Hicks, Derby (GB); Marcus Foale, Derby (GB)

(73) Assignee: ROLLS-ROYCE plc, London (GB)

( * ) Notice: Subject to any disclaimer, the term of this patent is extended or adjusted under 35 U.S.C. 154(b) by 242 days.

(21) Appl. No.: 15/421,030

(22) Filed: Jan. 31, 2017

(65) Prior Publication Data

US 2017/0241643 A1 Aug. 24, 2017

(30) Foreign Application Priority Data

Feb. 24, 2016 (GB) ..... 1603166.8

(51) Int. Cl.
*F23R 3/00* (2006.01)
*F23R 3/06* (2006.01)
*F23R 3/50* (2006.01)

(52) U.S. Cl.
CPC ..... *F23R 3/002* (2013.01); *F23R 3/06* (2013.01); *F23R 3/50* (2013.01); *F23R 3/007* (2013.01);

(Continued)

(58) Field of Classification Search
CPC .... F23R 3/00; F23R 3/002; F23R 3/06; F23R 3/50; F23R 3/007
See application file for complete search history.

(56) References Cited

U.S. PATENT DOCUMENTS 3,965,066 A * 6/1976 Sterman ..... F01D 9/023 60/800
3,995,422 A * 12/1976 Stamm ..... F23R 3/08 60/757

(Continued)

FOREIGN PATENT DOCUMENTS

EP 1813869 A2 8/2007
GB 2 087 065 A 5/1982

(Continued)

OTHER PUBLICATIONS

Jul. 29, 2016 Search Report issued in Great Britain Patent Application No. 1603166.8.

(Continued)

*Primary Examiner* — William H Rodriguez
*Assistant Examiner* — Eric W Linderman
(74) *Attorney, Agent, or Firm* — Oliff PLC

(57) ABSTRACT

A combustion chamber arrangement has an annular outer wall and an annular inner wall having an upstream row of tiles and a downstream row of tiles. The outer wall has a concave bend which is less than 175°. The downstream end of the upstream tiles and the upstream end of the downstream tiles are adjacent the concave bend. The downstream ends of the upstream tiles are spaced at a greater distance from the inner surface of the annular outer wall than the upstream end of the downstream tiles. The upstream tiles have curved lips extending in a downstream direction which overlap but are spaced radially from the upstream ends of the downstream tiles. The outer wall has a row of apertures to direct coolant onto the outer surfaces of the curved lips and the upstream tiles has a row of apertures extending to the inner surfaces of the curved lips.

24 Claims, 4 Drawing Sheets

(52) U.S. Cl.
CPC ..... *F23R 2900/03042* (2013.01); *F23R 2900/03044* (2013.01)

(56) References Cited

U.S. PATENT DOCUMENTS 4,077,205 A * 3/1978 Pane ..... F23R 3/08 60/757
4,253,301 A * 3/1981 Vogt ..... F23R 3/002 60/39.463
4,259,842 A * 4/1981 Koshoffer ..... F23R 3/08 60/757
4,485,630 A * 12/1984 Kenworthy ..... B23P 15/00 416/97 R
4,614,082 A * 9/1986 Sterman ..... F23R 3/002 60/752
4,622,821 A * 11/1986 Madden ..... F23R 3/06 60/755
4,655,044 A * 4/1987 Dierberger ..... F23R 3/002 60/753
4,773,227 A 9/1988 Chabis
4,901,522 A * 2/1990 Commaret ..... F23R 3/002 60/752
5,435,139 A * 7/1995 Pidcock ..... F23R 3/002 60/752
5,461,866 A * 10/1995 Sullivan ..... F23R 3/002 60/757
5,528,904 A * 6/1996 Jones ..... F01D 5/288 60/753
5,758,503 A * 6/1998 DuBell ..... F23R 3/002 60/752
6,029,455 A * 2/2000 Sandelis ..... F23R 3/002 60/752
6,145,319 A * 11/2000 Burns ..... F23R 3/002 60/754
6,240,731 B1 * 6/2001 Hoke ..... F23C 6/045 239/400
6,389,792 B1 * 5/2002 Hagle ..... F23R 3/08 60/753
6,666,025 B2 * 12/2003 Spooner ..... F23R 3/002 60/753
6,708,499 B2 * 3/2004 Pidcock ..... F23R 3/002 60/752
6,973,419 B1 * 12/2005 Fortin ..... F23R 3/002 477/30
7,007,481 B2 * 3/2006 McMasters ..... F23M 5/085 60/752
7,363,763 B2 * 4/2008 Coughlan, III ..... F23R 3/002 60/752
7,464,554 B2 * 12/2008 Cheung ..... F23R 3/00 60/754
8,266,914 B2 * 9/2012 Hawie ..... F01D 9/023 60/796
8,291,709 B2 * 10/2012 Cayre ..... F23R 3/06 60/752
8,359,866 B2 * 1/2013 Dierberger ..... F23M 5/02 60/752
8,661,826 B2 * 3/2014 Garry ..... C23C 4/02 60/752
9,068,748 B2 * 6/2015 Hoke ..... F23R 3/06
2003/0101731 A1 * 6/2003 Burd ..... F23M 5/02 60/796
2005/0022531 A1 * 2/2005 Burd ..... F23R 3/002 60/752
2006/0207259 A1 * 9/2006 Holt ..... F23M 5/085 60/772
2009/0077974 A1 * 3/2009 Dahlke ..... F23M 5/02 60/752
2013/0025288 A1 * 1/2013 Cunha ..... F23R 3/002 60/772
2013/0055722 A1 * 3/2013 Verhiel ..... F23R 3/007 60/772
2013/0074507 A1 * 3/2013 Kaleeswaran ..... F23R 3/002 60/754
2014/0083111 A1 * 3/2014 Gregg ..... F02C 3/14 60/779
2014/0360196 A1 * 12/2014 Graves ..... F23R 3/002 60/753
2015/0292741 A1 * 10/2015 Cunha ..... F23R 3/002 60/752
2016/0016230 A1 * 1/2016 Campomanes ..... C04B 35/638 264/118
2016/0054001 A1 * 2/2016 Bangerter ..... F23R 3/005 60/772
2016/0123594 A1 * 5/2016 Cunha ..... F23R 3/06 60/755
2016/0230996 A1 * 8/2016 Kostka ..... F23M 5/04
2016/0238248 A1 * 8/2016 Roberge ..... F23R 3/002
2016/0252249 A1 * 9/2016 Erbas-Sen ..... F23R 3/002 60/752
2016/0265774 A1 * 9/2016 Cunha ..... F23M 5/085
2016/0273772 A1 * 9/2016 Cunha ..... F23R 3/06
2016/0290642 A1 * 10/2016 Kwoka ..... F23R 3/002
2016/0290644 A1 * 10/2016 Cunha ..... F23R 3/06
2016/0305663 A1 * 10/2016 Lebel ..... F23R 3/002
2016/0320060 A1 * 11/2016 Chang ..... F23R 3/002
2016/0370009 A1 * 12/2016 Jin ..... F01D 9/023
2017/0159935 A1 * 6/2017 Drake ..... F01D 25/12
2017/0159936 A1 * 6/2017 Cunha ..... F23R 3/005
2017/0176005 A1 * 6/2017 Rimmer ..... F02C 7/12
2017/0184306 A1 * 6/2017 Tu ..... F23R 3/002
2017/0254538 A1 * 9/2017 Tu ..... F23R 3/002
2017/0307217 A1 * 10/2017 Clemen ..... F02C 7/18
2017/0356653 A1 * 12/2017 Bagchi ..... F23R 3/002
2018/0149361 A1 * 5/2018 Burd ..... F23R 3/002
2018/0231251 A1 * 8/2018 Burd ..... F23R 3/007
2018/0238179 A1 * 8/2018 Quach ..... F01D 9/023
2018/0238545 A1 * 8/2018 Quach ..... F23R 3/002
2018/0238547 A1 * 8/2018 Quach ..... F23R 3/06
2018/0335211 A1 * 11/2018 Quach ..... F23R 3/002
2018/0335212 A1 * 11/2018 Quach ..... F23R 3/002

FOREIGN PATENT DOCUMENTS

GB 2 223 839 A 4/1990
GB 2 355 301 A 4/2001
WO 2015/077600 A1 5/2015

OTHER PUBLICATIONS

Jul. 24, 2017 extended Search Report issued in European Patent Application No. 17153901.8.

* cited by examiner

COMBUSTION CHAMBER HAVING AN ANNULAR OUTER WALL WITH A CONCAVE BEND

The present disclosure relates to a combustion chamber and in particular to a gas turbine engine combustion chamber.

One known type of combustion chamber comprises one or more walls each of which comprises a double, or dual, wall structure. A dual wall structure comprises an annular outer wall and an annular inner wall spaced radially from the annular outer wall to define a chamber. The annular outer wall has a plurality of impingement apertures to supply coolant into the chamber and the annular inner wall has a plurality of effusion apertures to supply coolant from the chamber over an inner surface of the annular inner wall to provide a film of coolant on the inner surface of the annular inner wall. The film of coolant protects the inner surface of the annular inner wall.

The annular inner wall comprises a plurality of rows of circumferentially arranged tiles. These rows of tiles produce a discontinuity, or a number of discontinuities, in the inner surface of the annular inner wall that may have a detrimental effect on the film of coolant on the inner surface of the annular inner wall. It is required that the film of coolant flows smoothly from the downstream ends of one row of tiles and over the downstream row of tiles.

However, if the annular outer wall has a concave bend in a plane containing the axis of the combustion chamber and the downstream ends of the upstream row of tiles is adjacent the concave bend and the upstream ends of the downstream row of tiles is adjacent the concave bend and the angle of inclination between the inner surfaces of the tiles of the upstream row of tiles and the inner surfaces of the tiles in the downstream row of tiles is less than 175° then the film of coolant flowing from the inner surfaces of the tiles of the upstream row of tiles is deflected out into the main hot gas stream in the combustion chamber where it is readily dissipated and hence provides little cooling benefit. Furthermore, local pressure rises associated with a local stagnation zone of the main hot gas stream in the vicinity of the bend may prevent the coolant film flowing from the upstream row of tiles penetrating the stagnation zone and so prevent the formation of the cooling film on the inner surfaces of the downstream row of tiles.

The downstream ends of the tiles may have lips which extend axially towards but are spaced from the upstream ends of the adjacent downstream row of tiles, but the coolant flowing from the lips at the downstream ends of the tiles suffers from the same problems.

Thus, the upstream ends of the tiles in the downstream row of tiles has a relatively poor film of coolant and this results in thermal degradation, overheating, of the tiles in the downstream row of tiles. This leads to damage to these tiles and may reduce the service life of the tiles and may result in shorter time intervals between overhauls and repairs/replacement of tiles of the combustion chamber of the gas turbine engine. In addition, the outer wall may suffer from overheating at the bend due to the lack of a film of coolant at the downstream ends of the upstream row of tiles and the upstream ends of the downstream row of tiles.

It is not possible to cast tiles with a bend such that they could be aligned with the bend in the annular outer wall.

Accordingly the present disclosure seeks to provide a combustion chamber which reduces, or overcomes, the above mentioned problem.

According to a first aspect of the present disclosure there is provided a combustion chamber arrangement comprising an annular outer wall and an annular inner wall spaced from the annular outer wall, the annular inner wall comprising an upstream row of tiles and a downstream row of tiles, each row of tiles comprises a plurality of circumferentially arranged tiles, the annular outer wall having a concave bend in a plane containing the axis of the combustion chamber which is less than 175°, the downstream end of each tile in the upstream row of tiles is adjacent the concave bend and the upstream end of each tile in the downstream row of tiles is adjacent the concave bend, the upstream end of each tile in the downstream row of tiles has a rail extending from the upstream end of the tile towards and sealing with an inner surface of the annular outer wall downstream of the concave bend, the downstream end of each tile in the upstream row of tiles has a rail extending from the downstream end of the tile towards and sealing with the inner surface of the annular outer wall upstream of the concave bend, the downstream end of each tile in the upstream row of tiles is spaced at a greater distance from the inner surface of the annular outer wall than the upstream end of each tile in the downstream row of tiles, each tile in the upstream row of tiles has a curved lip extending in a downstream direction which overlaps the upstream ends of the tiles in the downstream row of tiles but is spaced radially from the upstream ends of the tiles in the downstream row of tiles and the annular outer wall has at least one row of apertures to direct coolant onto the outer surfaces of the curved lips at the downstream ends of the tiles in the upstream row of tiles.

Each tile in the upstream row of tiles may have at least one row of apertures extending there-through to an inner surface of the curved lip at the downstream end of the tile.

The upstream row of tiles may have at least one row of apertures extending from an outer surface of a main body of the tile to the inner surface of the main body of the tile.

The apertures in the at least one row of apertures extending from the outer surface of the main body of the tile to the inner surface of the main body of the tile in each tile of the upstream row of tiles may be arranged at an acute angle to the inner surface of the respective tile. The apertures in the at least one row of apertures in each tile of the upstream row of tiles may be arranged at an angle of 15° to 30° to the inner surface of the respective tile.

The upstream row of tiles may have at least one row of apertures extending from an outer surface of a main body of the tile to the inner surface of the curved lip at the downstream end of the tile.

The upstream row of tiles may have at least one row of apertures extending from an upstream surface of the rail through the rail to the inner surface of the curved lip at the downstream end of the tile.

The at least one row of apertures in each tile of the upstream row of tiles may extend through the tile at a junction between a main body of the tile, the rail and the curved lip.

The apertures in the at least one row of apertures in each tile of the upstream row of tiles may be arranged at an acute angle to the inner surface of the lip of the respective tile. The apertures in the at least one row of apertures in each tile of the upstream row of tiles may be arranged at an angle of 15° to 30° to the inner surface of the lip of the respective tile.

A downstream surface of the rail and the outer surface of the curved lip of each tile of the upstream row of tiles may form a smoothly curved surface.

The inner surface of the curved lip of each tile of the upstream row of tiles may form a smoothly curved surface.

Each tile in the downstream row of tiles may have a curved lip extending towards the annular outer wall.

The curved lips on the upstream row of tiles and the curved lips on the downstream row of tiles may define an annular duct converging in a downstream direction.

Each tile in the upstream row of tiles may comprise a main body, a rail at its upstream end, a rail at its downstream end, a curved lip at its downstream end and the lip curves away from the annular outer wall.

Each tile in the downstream row of tiles may comprise a main body, a rail at its upstream end, a rail at its downstream end, a curved lip at its upstream end and the lip curves towards the annular outer wall.

The outer surface of the downstream ends of the lips at the downstream ends of the upstream row of tiles may be arranged parallel to the inner surface of the tiles in the downstream row of tiles.

The downstream end of each tile in the upstream row of tiles may be spaced at a greater distance from the inner surface of the annular outer wall than the upstream end of each tile in the upstream row of tiles.

The downstream end of each tile in the upstream row of tiles and the upstream end of each tile in the upstream row of tiles may be spaced at the same distance from the inner surface of the annular outer wall.

The downstream end of each tile in the downstream row of tiles and the upstream end of each tile in the downstream row of tiles may be spaced at the same distance from the inner surface of the annular outer wall.

The at least one row of apertures in the annular outer wall may be arranged to supply the coolant to a chamber defined between the inner surface of the annular outer wall, the rails and the curved lips of the downstream ends of the tiles in the upstream row of tiles and the rails of the upstream ends of the downstream row of tiles.

The at least one row of apertures in the annular outer wall may be arranged to supply the coolant to a chamber defined between the inner surface of the annular outer wall, the rails and the curved lips of the downstream ends of the tiles in the upstream row of tiles and the rails and the curved lips of the upstream ends of the downstream row of tiles.

The tiles in the upstream row of tiles may be circumferentially staggered with respect to the tiles in the downstream row of tiles.

The axially extending edges of the tiles in the upstream row of tiles may extend with a circumferential component. The axially extending edges of the tiles in the downstream row of tiles may extend with a circumferential component.

The combustion chamber may be an annular combustion chamber and the annular outer wall is an annular radially outer wall of the annular combustion chamber and the annular inner wall is spaced radially within the annular radially outer wall.

The combustion chamber may be an annular combustion chamber and the annular outer wall is an annular radially inner wall of the annular combustion chamber and the annular inner wall is spaced radially around the annular radially inner wall.

The combustion chamber may be a tubular combustion chamber and the annular outer wall is an annular outer wall of the tubular combustion chamber and the annular inner wall is spaced radially within the annular outer wall.

According to a second aspect of the present disclosure there is provided a combustion chamber tile having a rail extending from a first surface of the tile at a first end of the tile, a curved lip extending from the first end of the tile and the curved lip curving away from the rail.

The tile may be parallelogram in shape in a plan view. The tile may be rectangular in shape in a plan view.

The tile has longitudinally spaced ends and laterally spaced edges.

The tile may be arcuate. The tile may be curved between its laterally spaced edges.

The tile may have a rail extending around the periphery of the first surface.

The first surface of the tile may be concave between its laterally spaced edges.

The first surface of the tile may be convex between its laterally spaced edges.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
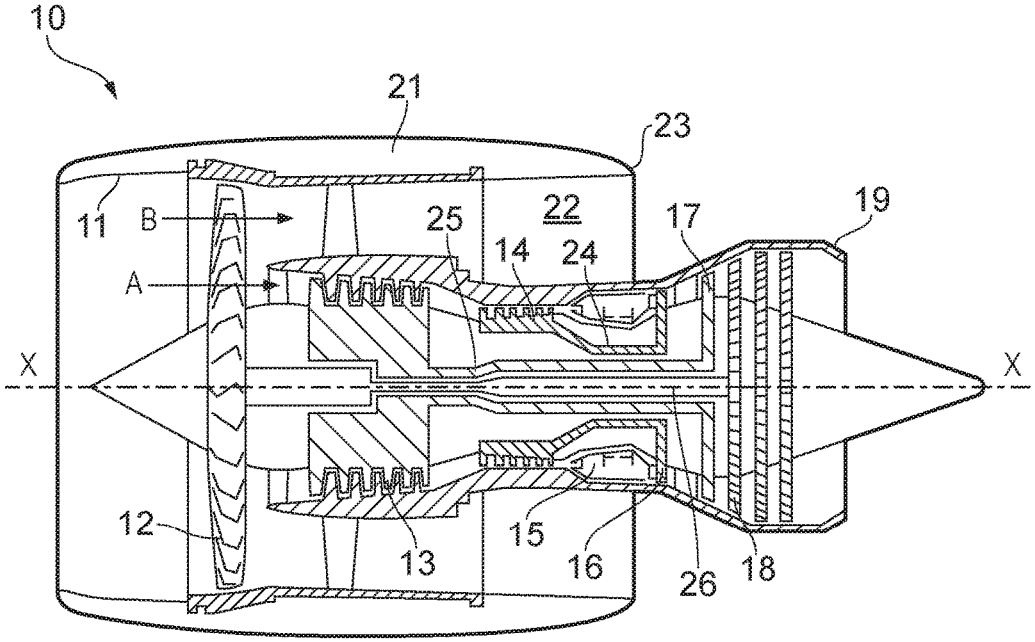
FIG. 1 is a sectional side view of a turbofan gas turbine engine having a combustion chamber arrangement according to the present disclosure.

With reference to FIG. 1, a turbofan gas turbine engine is generally indicated at 10, having a principal and rotational axis X. The engine 10 comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and an exhaust nozzle 19. A nacelle 21 generally surrounds the engine 10 and defines the intake 11, a bypass duct 22 and a bypass exhaust nozzle 23.

The gas turbine engine 10 works in the conventional manner so that air entering the intake 11 is compressed by the fan 12 to produce two air flows: a first air flow A into the intermediate pressure compressor 13 and a second air flow B which passes through a bypass duct 22 to provide propulsive thrust. The intermediate pressure compressor 13 compresses the air flow directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17 and 18 respectively before being exhausted through the exhaust nozzle 19 to provide additional propulsive thrust. The high 16, intermediate 17 and low 18 pressure turbines drive respectively the high pressure compressor 14, the intermediate pressure compressor 13 and the fan 12, each by suitable interconnecting shaft 24, 25 and 26 respectively.

Figure 2:
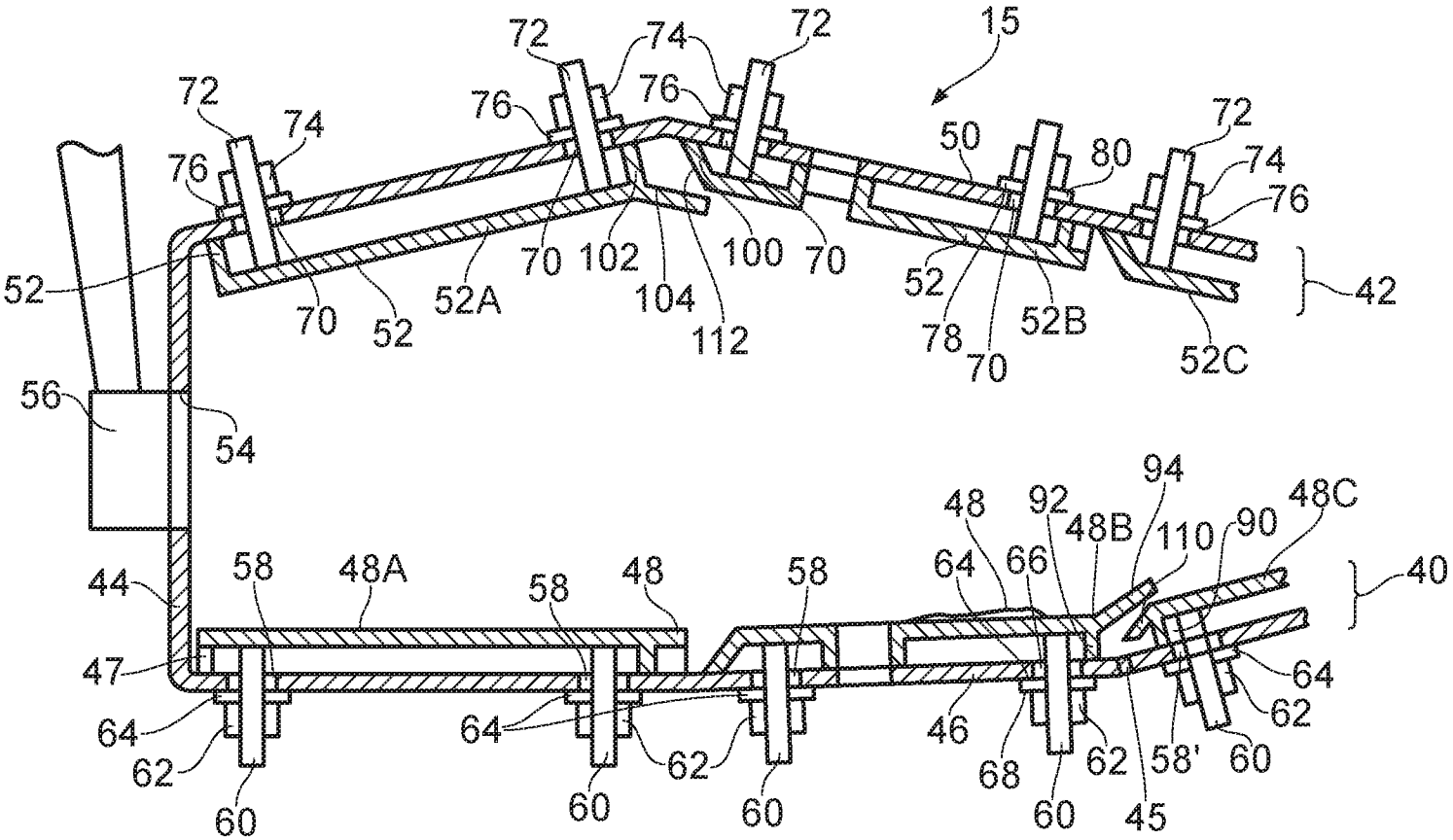
FIG. 2 is an enlarged cross-sectional view of a combustion chamber arrangement according to the present disclosure.
Figure 3:
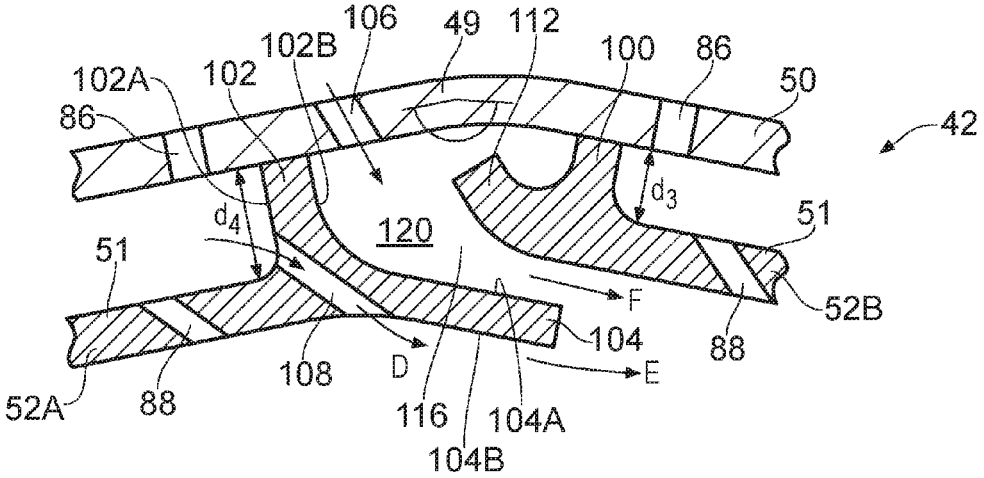
FIG. 3 is a further enlarged cross-sectional view of a portion of a combustion chamber arrangement according to the present disclosure.
Figure 4:
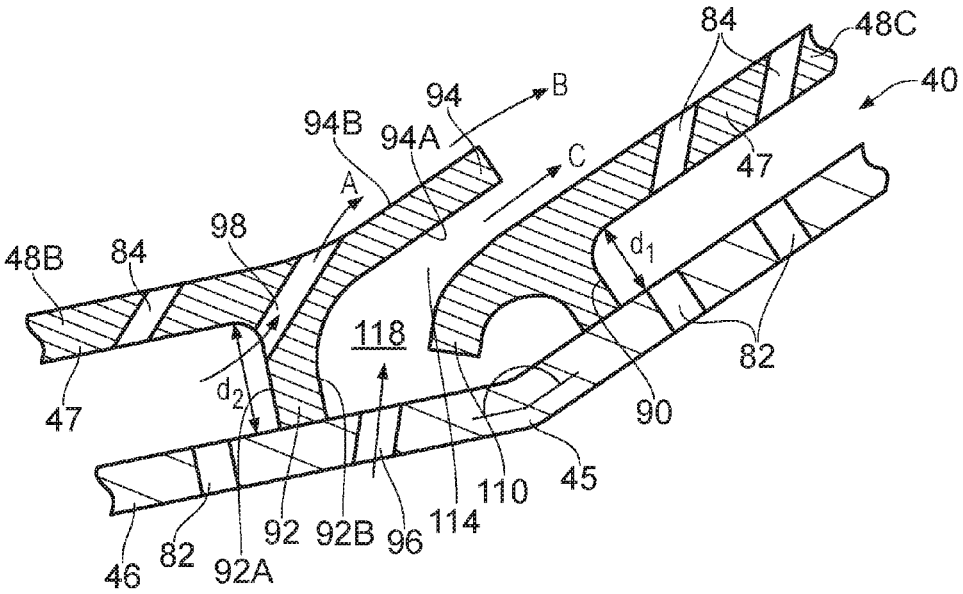
FIG. 4 is a further enlarged cross-sectional view of a further portion of a combustion chamber arrangement according to the present disclosure.

Combustion equipment 15 according to the present disclosure, as shown more clearly in FIGS. 2 to 4, comprises an annular combustion chamber arrangement and comprises a radially inner annular wall structure 40, a radially outer annular wall structure 42 and an upstream end wall structure 44. The radially inner annular wall structure 40 comprises a first annular wall 46 and a second annular wall 48. The radially outer annular wall structure 42 comprises a third annular wall 50 and a fourth annular wall 52. The second annular wall 48 is spaced radially from and is arranged radially around the first annular wall 46 and the first annular wall 46 supports the second annular wall 48. The fourth annular wall 52 is spaced radially from and is arranged radially within the third annular wall 50 and the third annular wall 50 supports the fourth annular wall 52. The upstream end of the first annular wall 46 is secured to the upstream end wall structure 44 and the upstream end of the third annular wall 50 is secured to the upstream end wall structure 44. The upstream end wall structure 44 has a plurality of circumferentially spaced apertures 54 and each aperture 54 has a respective one of a plurality of fuel injectors 56 located therein. The fuel injectors 56 are arranged to supply fuel into the annular combustion chamber 15 during operation of the gas turbine engine 10.

The first annular wall 46 has a plurality of mounting apertures 58 extending there-though and the second annular wall 48 has a plurality of fasteners 60 extending radially there-from. Each fastener 60 on the second annular wall 48 extends radially through a corresponding mounting aperture 58 in the first annular wall 46. A cooperating fastener 62 locates on each of the fasteners 60 extending through the mounting apertures 58 in the first annular wall 46. A washer 64 is positioned between each fastener 60 on the second annular wall 48 and the cooperating fastener 62. Each washer 64 has a first surface 66 abutting an outer surface of the first annular wall 46 and a second surface 68 abutting a surface of the cooperating fastener 62. The second annular wall 48 comprises a plurality of segments, or tiles, 48A, 48B and 48C and the segments, or tiles, 48A, 48B and 48C are arranged circumferentially and axially around the first annular wall 46. The axially extending edges of adjacent segments, or tiles, 48A, 48B and/or 48B may abut each other or may overlap each other and the circumferentially extending ends of adjacent segments, or tiles, 48A, 48B and 48C are spaced from each other.

Similarly, the third annular wall 50 has a plurality of mounting apertures 70 extending there-though and the fourth annular wall 52 has a plurality of fasteners 72 extending radially there-from. Each fastener 72 on the fourth annular wall 52 extends radially through a corresponding mounting aperture 70 in the third annular wall 50. A cooperating fastener 74 locates on each of the fasteners 72 extending through the mounting apertures 70 in the third annular wall 50. A washer 76 is positioned between each fastener 72 on the fourth annular wall 52 and the cooperating fastener 74. Each washer 76 has a first surface 78 abutting an outer surface of the third annular wall 50 and a second surface 80 abutting a surface of the cooperating fastener 74. The fourth annular wall 52 comprises a plurality of segments, or tiles, 52A, 52B and 52C and the segments, or tiles, 52A, 52B and 52C are arranged circumferentially and axially adjacent to each other to define the fourth annular wall 52. The axially extending edges of adjacent segments, or tiles, 52A, 52B and/or 52C may abut each other or may overlap each other and the circumferentially extending ends of adjacent segments, or tiles, 52A, 52B and 52C are spaced from each other.

The fasteners 60 and 72 on the second and fourth annular walls 48 and 52 are threaded studs which are cast integrally with the segments, or tiles, 48A, 48B, 48C, 52A 52B and 52C or may be secured to the segments, or tiles, 48A, 48B, 48C, 52A, 52B and 52C by welding, brazing etc. Alternatively, the fasteners, e.g. threaded studs are formed by additive layer manufacturing integrally with the segments, or tiles 48A, 48B, 48C, 52A 52B and 52C. The cooperating fasteners 62 and 74 are nuts.

The first and third annular walls 46 and 50 form annular outer walls of the annular combustion chamber 15 and the second and fourth annular walls 48 and 52 form annular inner walls of the annular combustion chamber 15. The second annular wall 48 comprises at least one row of circumferentially arranged tiles and in this example there are three rows 48A, 48B and 48C of circumferentially arranged tiles and the tiles 48A form an axially upstream row of circumferentially arranged tiles, the tiles 48B form an axially intermediate row of circumferentially arranged tiles and the tiles 48C form an axially downstream row of circumferentially arranged tiles. Similarly, the fourth annular wall 52 comprises at least one row of circumferentially arranged tiles and in this example there are three rows 52A, 52B and 52C of circumferentially arranged tiles and the tiles 52A form an axially upstream row of circumferentially arranged tiles, the tiles 52B form an axially intermediate row of circumferentially arranged tiles and the tiles 52C form an axially downstream row of circumferentially arranged tiles. The tiles 48A are an upstream row of tiles with respect to the tiles 48B and similarly the tiles 48B are a downstream row of tiles with respect to the tiles 48A. The tiles 48B are an upstream row of tiles with respect to the tiles 48C and similarly the tiles 48C are a downstream row of tiles with respect to the tiles 48B. The tiles 52A are an upstream row of tiles with respect to the tiles 52B and similarly the tiles 52B are a downstream row of tiles with respect to the tiles 52A. The tiles 52B are an upstream row of tiles with respect to the tiles 52C and similarly the tiles 52C are a downstream row of tiles with respect to the tiles 52B.

The first annular wall 46 has a plurality of impingement cooling apertures 82 extending there-through to direct coolant onto the outer surface of the tiles 48A, 48B and 48C and the tiles 48A, 48B and 48C have effusion cooling apertures 84 extending there-through to provide a film of coolant onto the inner surfaces of the tiles 48A, 48B and 48C respectively, as shown in FIG. 4. The impingement cooling apertures 82 are generally arranged perpendicularly to the surfaces of the first annular wall 46 and the outer surfaces of the tiles 48A, 48B and 48C respectively. The effusion cooling apertures 84 are generally arranged at an acute angle, for example 30°, to the inner surfaces of the tiles 48A, 48B and 48C but other suitable angles may be used. Some effusion cooling apertures 84 may be arranged perpendicularly to the inner surfaces of the tiles 48A, 48B and 48C and some of the effusion cooling apertures 84 may be arranged at an acute angle, for example 30°, to the inner surfaces of the tiles 48A, 48B and 48C. The tiles 48A, 48B and 48C may have a plurality of rows of effusion cooling apertures 84 extending from the outer surface of the main body 47 of the tile 48A, 48B, 48C to the inner surface of the main body 47 of the tile 48A, 48B and 48C. The effusion cooling apertures in the at least one row of effusion cooling apertures 84 in the main body 47 of the tile may be arranged at an acute angle to the inner surface of the respective tile. The effusion cooling apertures in the at least one row of effusion cooling apertures 84 in each tile may be arranged at an angle of 15° to 30° to the inner surface of the respective tile 48A, 48B and 48C. The effusion cooling apertures 84 arranged at an acute angle to the inner surface of the respective tile are arranged to direct the coolant in a downstream direction, e.g. away from the upstream end wall structure 44.

Similarly, the third annular wall 50 has a plurality of impingement cooling apertures 86 extending there-through to direct coolant onto the outer surface of the tiles 52A, 52B and 52C and the tiles 52A, 52B and 52C have effusion cooling apertures 88 extending there-through to provide a film of coolant onto the inner surfaces of the tiles 52A, 52B and 52C respectively, as shown in FIG. 3. The impingement cooling apertures 86 are generally arranged perpendicularly to the surfaces of the third annular wall 50 and the outer surfaces of the tiles 52A, 52B and 52C respectively. The effusion cooling apertures 88 are generally arranged at an acute angle, for example 30°, to the inner surfaces of the tiles 52A, 52B and 52C but other suitable angles may be used. Some effusion cooling apertures 88 may be arranged perpendicularly to the inner surfaces of the tiles 52A, 52B and 52C and some of the effusion cooling apertures 88 may be arranged at an acute angle, for example 30°, to the inner surfaces of the tiles 52A, 52B and 52C. The tiles 52A, 52B and 52C may have a plurality of rows of effusion cooling apertures 88 extending from the outer surface of the main body 51 of the tile 52A, 52B, 52C to the inner surface of the main body 51 of the tile 52A, 52B and 52C. The effusion cooling apertures in the at least one row of effusion cooling apertures 88 in the main body 51 of the tile may be arranged at an acute angle to the inner surface of the respective tile. The effusion cooling apertures in the at least one row of effusion cooling apertures 88 in each tile may be arranged at an angle of 15° to 30° to the inner surface of the respective tile 52A, 52B and 52C. The effusion cooling apertures 84 arranged at an acute angle to the inner surface of the respective tile are arranged to direct the coolant in a downstream direction, e.g. away from the upstream end wall structure 44.

It is to be noted that the first annular wall 46 has a concave bend 45 in a plane containing the axis X of the combustion chamber 15 which is less than 175°, as shown in FIG. 4, and similarly the third annular wall 50 has a concave bend in a plane containing the axis X of the combustion chamber 15 which is less than 175°, as shown in FIG. 3.

Referring again to FIG. 4, the downstream end of each tile in the upstream row of tiles 48B is adjacent the concave bend 45 and the upstream end of each tile in the downstream row of tiles 48C is adjacent the concave bend 45. The upstream end of each tile in the downstream row of tiles 48C has a rail 90 extending from the upstream end of the tile towards and sealing with an inner surface of the first annular wall 46. Each rail 90 abuts the inner surface of the first annular wall 46 downstream of the bend 45. The downstream end of each tile in the upstream row of tiles 48B has a rail 92 extending from the downstream end of the tile towards and sealing with an inner surface of the first annular wall 46. Each rail 92 abuts the inner surface of the first annular wall 46 upstream of the bend 45. The downstream end of each tile in the upstream row of tiles 48B is spaced at a distance $d_2$ from the inner surface of the first annular wall 46 and the upstream end of each tile in the downstream row of tiles 48C is spaced at a distance $d_1$ from the inner surface of the first annular wall 46 and the distance $d_2$ is greater than the distance $d_1$. The outer surface of the main body 47 of each tile in the upstream row of tiles 48B forms an acute angle with the inner surface of the first annular wall 46.

Each tile in the upstream row of tiles 48B has a curved lip 94 extending in a downstream direction which overlaps the upstream ends of the tiles in the downstream row of tiles 48C but is spaced radially from the upstream ends of the tiles in the downstream row of tiles 48C.

The first annular wall 46 has at least one row of apertures 96 to direct coolant onto the outer surfaces 94A of the curved lips 94 at the downstream ends of the tiles in the upstream row of tiles 48B and each tile in the upstream row of tiles 48B has at least one row of effusion cooling apertures 98 extending there-through to the inner surface 94B of the curved lip 94 at the downstream end of the tile 48B. The at least one row of apertures 96 is located downstream of the rails 92 of the upstream row of tiles 48B and upstream of the bend 45, e.g. between the rails 92 of the upstream row of tiles 48B and the bend 45. The at least one row of effusion cooling apertures 98 extends from the upstream surface 92A of the rail 92 through the rail 92 to the inner surface 94B of the curved lip 94 at the downstream end of the tile 48B. The at least one row of effusion cooling apertures 98 in each tile of the upstream row of tiles 48B in particular extend through the tile at the junction between the main body 47 of the tile, the rail 92 and the curved lip 94. The apertures in the at least one row of effusion cooling apertures 98 in each tile of the upstream row of tiles 48B may be arranged at an acute angle to the inner surface 94B of the curved lip 94 of the respective tile 48B. The effusion cooling apertures 98 in the at least one row of effusion cooling apertures in each tile of the upstream row of tiles 48B may be arranged at an angle of 15° to 30° to the inner surface 94B of the curved lip 94 of the respective tile 48B.

The downstream surface 92B of the rail 92 and the radially outer surface 94A of the curved lip 94 of each tile of the upstream row of tiles 48B form a smoothly curved surface. The radially inner surface 94B of the curved lip 94 of each tile of the upstream row of tiles 48B forms a smoothly curved surface. Each tile in the downstream row of tiles 48C has a curved lip 110 extending in an upstream direction and towards the first annular wall 46. The curved lips 94 on the upstream row of tiles 48B and the curved lips 110 on the downstream row of tiles 48C define an annular duct 114 converging in a downstream direction.

In this arrangement the outer surface 94A of the downstream ends of the curved lips 94 at the downstream ends of the upstream row of tiles 48B are arranged parallel to the inner surface of the tiles in the downstream row of tiles 48C.

The rails 90 and the curved lips 110 extend from the upstream ends of the main bodies 47 of the tiles in the downstream row of tiles 48C and the rails 92 and the curved lips 94 extend from the downstream ends of the main bodies 47 of the tiles in the upstream row of tiles 48B.

Thus, each tile in the upstream row of tiles 48B comprises a main body 47, a rail at its upstream end, a rail 92 at its downstream end, a curved lip 94 at its downstream end and the curved lip 94 curves away from the first annular wall 46. In particular, the curved lip 94 of each tile in the upstream row of tiles 48B curves away from the first annular wall 46 upstream of the bend 45. Each tile in the downstream row of tiles 48C comprises a main body 47, a rail 90 at its upstream end, a rail at its downstream end, a curved lip 110 at its upstream end and the curved lip 110 curves towards the first annular wall 46.

The downstream end of each tile in the upstream row of tiles 48B is spaced at a greater distance from the inner surface of the first annular wall 46 than the upstream end of each tile in the upstream row of tiles 48B, as shown in FIG. 2. The downstream end of each tile in the downstream row of tiles 48C and the upstream end of each tile in the downstream row of tiles 48C are spaced at the same distance from the inner surface of the first annular wall 46. The advantage of this arrangement is that the curvature of the curved lips 94 at the downstream ends of the tiles in the row of tile 48B is reduced whilst ensuring the film of coolant is directed and aligned to flow over the inner surface of the tiles in the downstream row of tiles 48C.

Similarly, referring again to FIG. 3, the downstream end of each tile in the upstream row of tiles 52A is adjacent the concave bend 49 and the upstream end of each tile in the downstream row of tiles 52BC is adjacent the concave bend 49. The upstream end of each tile in the downstream row of tiles 52B has a rail 100 extending from the upstream end of the tile towards and sealing with an inner surface of the third annular wall 50. Each rail 100 abuts the inner surface of the third annular wall 50 downstream of the bend 49. The downstream end of each tile in the upstream row of tiles 52A has a rail 102 extending from the downstream end of the tile towards and sealing with an inner surface of the third annular wall 50. Each rail 102 abuts the inner surface of the third annular wall 50 upstream of the bend 49. The downstream end of each tile in the upstream row of tiles 52A is spaced at a distance $d_4$ from the inner surface of the third annular wall 50 and the upstream end of each tile in the downstream row of tiles 52B is spaced at a distance $d_3$ from the inner surface of the third annular wall 50 and the distance $d_4$ is greater than the distance $d_3$. Each tile in the upstream row of tiles 52A has a curved lip 104 extending in a downstream direction which overlaps the upstream ends of the tiles in the downstream row of tiles 52B but is spaced radially from the upstream ends of the tiles in the downstream row of tiles 52B.

The third annular wall 50 has at least one row of apertures 106 to direct coolant onto the outer surfaces 104A of the curved lips 104 at the downstream ends of the tiles in the upstream row of tiles 52A and each tile in the upstream row of tiles 52A has at least one row of effusion cooling apertures 108 extending there-through to the inner surface 104B of the curved lip 104 at the downstream end of the tile 52A. The at least one row of apertures 106 is located downstream of the rails 102 of the upstream row of tiles 52A and upstream of the bend 49, e.g. between the rails 102 of the upstream row of tiles 52A and the bend 49. The at least one row of effusion cooling apertures 108 extends from the upstream surface 102A of the rail 102 through the rail 102 to the inner surface 104B of the curved lip 104 at the downstream end of the tile 52A. The at least one row of effusion cooling apertures 108 in each tile of the upstream row of tiles 52A in particular extends through the tile at the junction between the main body 51 of the tile, the rail 102 and the curved lip 104. The apertures in the at least one row of effusion cooling apertures 108 in each tile of the upstream row of tiles 52A may be arranged at an acute angle to the inner surface 104B of the curved lip 104 of the respective tile 52A. The effusion cooling apertures 108 in the at least one row of effusion cooling apertures in each tile of the upstream row of tiles 52A may be arranged at an angle of 15° to 30° to the inner surface 104B of the curved lip 104 of the respective tile 52A.

The downstream surface 102B of the rail 102 and the radially outer surface 104A of the curved lip 104 of each tile of the upstream row of tiles 52A form a smoothly curved surface. The radially inner surface 104B of the curved lip 104 of each tile of the upstream row of tiles 52A forms a smoothly curved surface. Each tile in the downstream row of tiles 52B has a curved lip 112 extending in an upstream direction and towards the third annular wall 50. The curved lips 104 on the upstream row of tiles 52A and the curved lips 112 on the downstream row of tiles 52B define an annular duct 116 converging in a downstream direction.

In this arrangement the outer surface 104A of the downstream ends of the curved lips 104 at the downstream ends of the upstream row of tiles 52A are arranged parallel to the inner surface of the tiles in the downstream row of tiles 52B.

The rails 100 and the curved lips 112 extend from the upstream ends of the main bodies 51 of the tiles in the downstream row of tiles 52B and the rails 102 and the curved lips 104 extend from the downstream ends of the main bodies 51 of the tiles in the upstream row of tiles 52A.

Thus, each tile in the upstream row of tiles 52A comprises a main body 51, a rail at its upstream end, a rail 102 at its downstream end, a curved lip 104 at its downstream end and the curved lip 104 curves away from the third annular wall 50. In particular, the curved lip 104 of each tile in the upstream row of tiles 52A curves away from the third annular wall 50 upstream of the bend 49. Each tile in the downstream row of tiles 52B comprises a main body 51, a rail 100 at its upstream end, a rail at its downstream end, a curved lip 112 at its upstream end and the curved lip 112 curves towards the third annular wall 50.

The downstream end of each tile in the upstream row of tiles 52A and the upstream end of each tile in the upstream row of tiles 52A are spaced at the same distance from the inner surface of the third annular wall 50, as seen in FIG. 2. The downstream end of each tile in the downstream row of tiles 52B and the upstream end of each tile in the downstream row of tiles 52B are spaced at the same distance from the inner surface of the third annular wall 50. But, the upstream row of tiles 52A are spaced at a greater distance from the inner surface of the third annular wall 50 than the downstream row of tiles 52B.

In operation coolant, air, is supplied through the impingement cooling apertures 82 in the first annular wall 46 to chambers defined between the first annular wall 46 and each tile in each of the rows of tiles 48A, 48B and 48C and the coolant impinges on the outer, cold, surfaces of the tiles to provide impingement cooling thereof. The coolant, air, then flows through the effusion cooling apertures 84 in the tiles in each of the rows of tiles 48A, 48B and 48C to provide a film of coolant on the inner, hot, surfaces of the tiles. Some of the coolant in the chambers defined by the upstream row of tiles 48B flows A through the effusion cooling apertures 98 and over the inner, hot, surfaces 94B of the curved lips 94 of the upstream row of tiles 48B and then flows B over the upstream ends of the downstream row of tiles 48C. The at least one row of apertures 96 in the first annular wall 46 supply the coolant, air, to a chamber 118 defined between the inner surface of the first annular wall 46, the rails 92 and the curved lips 94 of the downstream ends of the tiles in the upstream row of tiles 48B and the rails 90 of the upstream ends of the downstream row of tiles 48C and in particular by the inner surface of the first annular wall 46, the rails 92 and the curved lips 94 of the downstream ends of the tiles in the upstream row of tiles 48B and the rails 90 and the curved lips 110 of the upstream ends of the downstream row of tiles 48C. The coolant, air, in the chamber 118 flows C through the convergent duct 114 defined between the outer surfaces 94A of the curved lips 94 at the downstream ends of the upstream row of tiles 48B and the curved lips 110 of the upstream ends of the downstream row of tiles 48C and over the upstream ends of the tiles in the downstream row of tiles 48C to reinforce the flow of coolant B.

Similarly, coolant, air, is supplied through the impingement cooling apertures 86 in the third annular wall 50 to chambers defined between the third annular wall 50 and each tile in each of the rows of tiles 52A, 52B and 52C and the coolant impinges on the outer, cold, surfaces of the tiles to provide impingement cooling thereof. The coolant, air, then flows through the effusion cooling apertures 88 in the tiles in each of the rows of tiles 52A, 52B and 52C to provide a film of coolant on the inner, hot, surfaces of the tiles. Some of the coolant in the chambers defined by the upstream row of tiles 52A flows D through the effusion cooling apertures 108 and over the inner, hot, surfaces 104B of the curved lips 104 of the upstream row of tiles 52A and then flows E over the upstream ends of the downstream row of tiles 52B. The at least one row of apertures 106 in the third annular wall 50 supply the coolant, air, to a chamber 120 defined between the inner surface of the third annular wall 50, the rails 102 and the curved lips 104 of the downstream ends of the tiles in the upstream row of tiles 52A and the rails 100 of the upstream ends of the downstream row of tiles 52B and in particular by the inner surface of the third annular wall 50, the rails 102 and the curved lips 104 of the downstream ends of the tiles in the upstream row of tiles 52A and the rails 100 and the curved lips 112 of the upstream ends of the downstream row of tiles 52B. The coolant, air, in the chamber 120 flows F through the convergent duct 116 defined between the outer surfaces 104A of the curved lips 104 at the downstream ends of the upstream row of tiles 52A and the curved lips 112 of the upstream ends of the downstream row of tiles 52B and over the upstream ends of the tiles in the downstream row of tiles 52B to reinforce the flow of coolant E.

Figure 5:
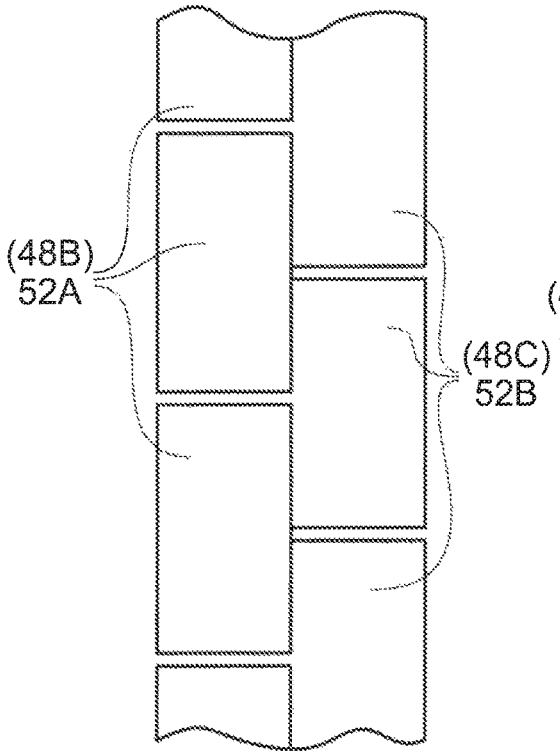
FIG. 5 is a plan view of the tiles shown in FIG. 3.

FIG. 5 shows an arrangement in which the tiles in the upstream row of tiles 48B or 52A are circumferentially staggered with respect to the tiles in the downstream row of tiles 48C or 52B respectively and thus the axially extending edges of the tiles extend purely in an axial direction. The use of the stagger enables the film of coolant from the upstream row of tiles 48B or 52A to flow over the upstream ends of the axially extending edges of downstream row of tiles 48C or 52B respectively to provide better cooling of the upstream ends of the edges.

Figure 6:
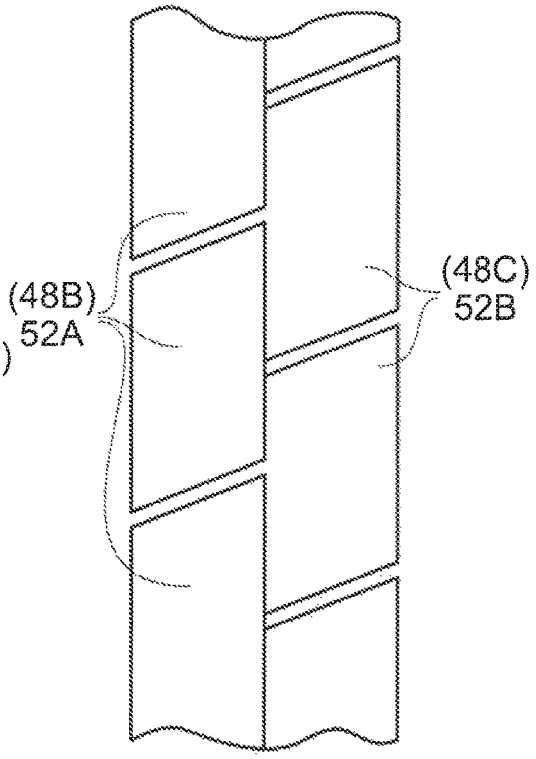
FIG. 6 is an alternative plan view of the tiles shown in FIG. 3.

FIG. 6 shows an arrangement in which the tiles in the upstream row of tiles 48B or 52A are circumferentially staggered with respect to the tiles in the downstream row of tiles 48C or 52B respectively and the axially extending edges of the tiles in the upstream row of tiles 48B or 52A extend with a circumferential component. The axially extending edges of the tiles in the downstream row of tiles 48C or 52B also extend with a circumferential component. The axially extending edges may be arranged at an angle of about 10° to 40° to the axis of the combustion chamber 15, for example 30° to the axis of the combustion chamber 15, e.g. the axis X of the gas turbine engine 10. The use of the stagger enables the film of coolant from the upstream row of tiles 48B or 52A to flow over the upstream ends of the axially extending edges of downstream row of tiles 48C or 52B respectively to provide better cooling of the upstream ends of the edges. The angling of the edges of the tiles 48A, 48B, 52A, and 52B enables the film of coolant to flow from one tile in a row of tiles to a circumferentially adjacent tile in the row of tiles and hence provide better cooling of the edges of the tiles in the row of tiles.

The upstream row of tiles may have at least one row of apertures extending from the outer surface of the main body of the tile to the inner surface of the curved lip at the downstream end of the tile.

Although the present disclosure has been described with reference to at least one row of apertures extending to the inner surface of the curved lip it may be possible to dispense with these apertures.

The effusion cooling apertures 84, 88, 98 and 108 may be circular in cross-section throughout their lengths or they may have circular cross-section metering portions and fan shaped outlet portions or other suitable shapes.

Although the present disclosure has been described with reference to an annular radially outer wall and an annular inner wall spaced radially within the annular radially outer wall of an annular combustion chamber and/or an annular radially inner wall and an annular inner wall is spaced radially around the annular radially inner wall of an annular combustion chamber the present disclosure is equally applicable to a tubular combustion chamber comprising an annular outer wall and an annular inner wall spaced radially within the annular outer wall.

Although the present disclosure has been described with reference to a turbofan gas turbine engine it is equally applicable to a turbojet gas turbine engine, a turbo-propeller gas turbine engine or a turbo-shaft gas turbine engine.

Although the present disclosure has been described with reference to an aero gas turbine engine it is equally applicable to a marine gas turbine engine, an automotive gas turbine engine or an industrial gas turbine engine.

The downstream ends of the tiles in the upstream row of tiles are spaced at a greater distance from the annular outer wall than the upstream ends of the tiles in the downstream row of tiles such that the curved lips at the downstream ends of the tiles in the upstream row of tiles overlap the upstream ends of the tiles in the downstream row of tiles. This arrangement allows a film of coolant to be generated over the upstream ends of the tiles in the downstream row of tiles in the presence of a concave bend in the outer annular wall. The curved lips at the downstream ends of the tiles in the upstream row of tiles also prevent the formation of a stagnation zone at the point of inflection between the two rows of adjacent tiles. The smoothly curved inner surfaces of the curved lips help to guide the coolant, air, to form the film of coolant on the inner surface of the tiles of the downstream row of tiles onto the inner surfaces of the curved lips to cool them. The smoothly curved downstream surfaces of the rails and the outer surfaces of the curved lips of the tiles of the upstream row of tiles and the smoothly curved inner surface of the curved lips of the tiles of the downstream row of tiles help to guide the coolant, air, from the row of apertures in the annular outer wall that is to form the film of coolant on the inner surface of the tiles in the downstream row of tiles over the outer surfaces of the curved lips of the downstream row of tiles to cool them. The smoothly curved downstream surfaces of the rails and the outer surfaces of the curved lips of the tiles of the upstream row of tiles and the smoothly curved inner surface of the curved lips of the tiles of the downstream row of tiles also help to minimise the pressure loss associated with providing the cooling film of air onto the outer surfaces of the curved lips of the downstream ends of the upstream row of tiles and helps to ensure that a circumferentially and radially uniform film of coolant is provided on the inner surface of the downstream row of tiles. The smoothly curved downstream surfaces of the rails and the outer surfaces of the curved lips of the tiles of the upstream row of tiles and the smoothly curved inner surface of the curved lips of the tiles of the downstream row of tiles also help to reduce the size of the chamber defined therebetween. Minimisation of this chamber also reduces the pressure loss associated with providing the cooling film of air onto the outer surfaces of the curved lips of the downstream ends of the upstream row of tiles and also reduces the possibility of the formation of three dimensional secondary flows within the chamber which may disrupt the uniformity of the film of coolant. The gap between the curved lips on the downstream ends of the tiles of the upstream row of tiles and the upstream ends of the downstream row of tiles is arranged such that the velocity differential between the film of coolant and the hot combustion gases in the combustion chamber is minimised to delay mixing out of the film of coolant.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber arrangement comprising an annular outer wall and an annular inner wall spaced from the annular outer wall, the annular outer wall being curved in a plane perpendicular to the axis of the combustion chamber, the annular outer wall having an upstream portion and a downstream portion, the annular outer wall having a concave bend in a plane containing the axis of the combustion chamber, the plane containing the axis of the combustion chamber having a straight line which is co-linear with the axis of the combustion chamber, the concave bend being arranged between and connecting the upstream portion and the downstream portion of the annular outer wall, the downstream portion of the annular outer wall being arranged at an angle to the upstream portion of the annular outer wall by the concave bend, the concave bend is less than 175°, the annular inner wall comprising an upstream row of tiles and a downstream row of tiles, each row of tiles comprises a plurality of circumferentially arranged tiles, the downstream end of each tile in the upstream row of tiles is adjacent the concave bend and the upstream end of each tile in the downstream row of tiles is adjacent the concave bend, the upstream end of each tile in the downstream row of tiles has a rail extending from the upstream end of the tile towards and sealing with an inner surface of the downstream portion of the annular outer wall downstream of the concave bend, the downstream end of each tile in the upstream row of tiles has a rail extending from the downstream end of the tile towards and sealing with the inner surface of the upstream portion of the annular outer wall upstream of the concave bend, the downstream end of each tile in the upstream row of tiles is spaced at a greater distance from the inner surface of the annular outer wall than the upstream end of each tile in the downstream row of tiles, each tile in the upstream row of tiles has a curved lip extending in a downstream direction which overlaps the upstream ends of the tiles in the downstream row of tiles and is spaced radially from the upstream ends of the tiles in the downstream row of tiles and the annular outer wall has at least one row of apertures to direct coolant onto outer surfaces of the curved lips at the downstream ends of the tiles in the upstream row of tiles.

2. The combustion chamber as claimed in claim 1 wherein each tile in the upstream row of tiles has at least one row of apertures extending there-through to an inner surface of the curved lip at the downstream end of the tile.

3. The combustion chamber as claimed in claim 2 wherein the at least one row of apertures of the upstream row of tiles extends from an outer surface of a main body of the tile to the inner surface of the curved lip at the downstream end of the tile.

4. The combustion chamber as claimed in claim 2 wherein the at least one row of apertures of the upstream row of tiles extends from an upstream surface of the rail through the rail to the inner surface of the curved lip at the downstream end of the tile.

5. The combustion chamber as claimed in claim 4 wherein the at least one row of apertures in each tile of the upstream row of tiles extends through the tile at a junction between a main body of the tile, the rail and the curved lip.

6. The combustion chamber as claimed in claim 2 wherein the apertures in the at least one row of apertures in each tile of the upstream row of tiles are arranged at an angle of 15° to 30° to the inner surface of the curved lip of the respective tile.

7. The combustion chamber as claimed in claim 1 wherein the upstream row of tiles has at least one row of apertures extending from an outer surface of a main body of the tile to an inner surface of the main body of the tile.

8. The combustion chamber as claimed in claim 7 wherein each aperture in the at least one row of apertures in each tile of the upstream row of tiles is arranged at an angle of 15° to 30° to the inner surface of the respective tile.

9. The combustion chamber as claimed in claim 1 wherein a downstream surface of the rail of each tile of the upstream row of tiles and the outer surface of the curved lip of each tile of the upstream row of tiles form a smoothly curved surface.

10. The combustion chamber as claimed in claim 1 wherein the inner surface of the curved lip of each tile of the upstream row of tiles form a smoothly curved surface.

11. The combustion chamber as claimed in claim 1 wherein each tile in the downstream row of tiles has a curved lip extending towards the annular outer wall.

12. The combustion chamber as claimed in claim 11 wherein the curved lips on the upstream row of tiles and the curved lips on the downstream row of tiles define an annular duct converging in a downstream direction.

13. The combustion chamber as claimed in claim 1 wherein each tile in the upstream row of tiles comprises a main body, a rail at its upstream end, the rail at its downstream end, the curved lip at its downstream end and the curved lip curves away from the annular outer wall.

14. The combustion chamber as claimed in claim 11 wherein each tile in the downstream row of tiles comprises a main body, the rail at its upstream end, a rail at its downstream end, a curved lip at its upstream end and the curved lip curves towards the annular outer wall.

15. The combustion chamber as claimed in claim 1 wherein the outer surface of the downstream ends of the lips at the downstream ends of the upstream row of tiles are arranged parallel to the inner surface of the tiles in the downstream row of tiles.

16. The combustion chamber as claimed in claim 1 wherein the downstream end of each tile in the upstream row of tiles is spaced at a greater distance from the inner surface of the annular outer wall than the upstream end of each tile in the upstream row of tiles.

17. The combustion chamber as claimed in claim 1 wherein the downstream end of each tile in the upstream row of tiles and the upstream end of each tile in the upstream row of tiles are spaced at the same distance from the inner surface of the annular outer wall.

18. The combustion chamber as claimed in claim 1 wherein the downstream end of each tile in the downstream row of tiles and the upstream end of each tile in the downstream row of tiles are spaced at the same distance from the inner surface of the annular outer wall.

19. The combustion chamber as claimed in claim 1 wherein the at least one row of apertures in the annular outer wall is arranged to supply the coolant to a chamber defined between the inner surface of the annular outer wall, the rails and the curved lips of the downstream ends of the tiles in the upstream row of tiles and the rails of the upstream ends of the downstream row of tiles.

20. The combustion chamber as claimed in claim 1 wherein the at least one row of apertures in the annular outer wall is arranged to supply the coolant to a chamber defined between the inner surface of the annular outer wall, the rails and the curved lips of the downstream ends of the tiles in the upstream row of tiles and the rails and the curved lips of the upstream ends of the downstream row of tiles.

21. The combustion chamber as claimed in claim 1 wherein the combustion chamber is an annular combustion chamber and the annular outer wall is an annular radially outer wall of the annular combustion chamber and the annular inner wall is spaced radially within the annular radially outer wall.

22. The combustion chamber as claimed in claim 1 wherein the combustion chamber is an annular combustion chamber and the annular outer wall is an annular radially inner wall of the annular combustion chamber and the annular inner wall is spaced radially around the annular radially inner wall.

23. A combustion chamber arrangement comprising an annular outer wall and an annular inner wall spaced from the annular outer wall, the annular inner wall comprising an upstream row of tiles and a downstream row of tiles, each row of tiles comprises a plurality of circumferentially arranged tiles, the annular outer wall having a concave bend in a plane containing the axis of the combustion chamber which is less than 175°, the downstream end of each tile in the upstream row of tiles is adjacent the concave bend and the upstream end of each tile in the downstream row of tiles is adjacent the concave bend, the upstream end of each tile in the downstream row of tiles has a rail extending from the upstream end of the tile towards and sealing with an inner surface of the annular outer wall downstream of the concave bend, the downstream end of each tile in the upstream row of tiles has a rail extending from the downstream end of the tile towards and sealing with the inner surface of the annular outer wall upstream of the concave bend, the downstream end of each tile in the upstream row of tiles is spaced at a greater distance from the inner surface of the annular outer wall than the upstream end of each tile in the downstream row of tiles, each tile in the upstream row of tiles has a curved lip extending in a downstream direction which overlaps the upstream ends of the tiles in the downstream row of tiles and is spaced radially from the upstream ends of the tiles in the downstream row of tiles, an inner surface of the curved lip of each tile of the upstream row of tiles forms a smoothly curved surface, and the annular outer wall has at least one row of apertures to direct coolant onto outer surfaces of the curved lips at the downstream ends of the tiles in the upstream row of tiles.

24. A combustion chamber arrangement comprising an annular outer wall and an annular inner wall spaced from the annular outer wall, the annular inner wall comprising an upstream row of tiles and a downstream row of tiles, each row of tiles comprises a plurality of circumferentially arranged tiles, the annular outer wall having a concave bend such that the combustion chamber narrows in an axial direction toward an outlet of the combustion chamber downstream of the concave bend, the concave bend being less than 175°, the downstream end of each tile in the upstream row of tiles is adjacent the concave bend and the upstream end of each tile in the downstream row of tiles is adjacent the concave bend, the upstream end of each tile in the downstream row of tiles has a rail extending from the upstream end of the tile towards and sealing with an inner surface of the annular outer wall downstream of the concave bend, the downstream end of each tile in the upstream row of tiles has a rail extending from the downstream end of the tile towards and sealing with the inner surface of the annular outer wall upstream of the concave bend, the downstream end of each tile in the upstream row of tiles is spaced at a greater distance from the inner surface of the annular outer wall than the upstream end of each tile in the downstream row of tiles, each tile in the upstream row of tiles has a curved lip extending in a downstream direction which overlaps the upstream ends of the tiles in the downstream row of tiles and is spaced radially from the upstream ends of the tiles in the downstream row of tiles and the annular outer wall has at least one row of apertures to direct coolant onto outer surfaces of the curved lips at the downstream ends of the tiles in the upstream row of tiles.

* * * * *